US006299021B1

(12) United States Patent
Haas

(10) Patent No.: US 6,299,021 B1
(45) Date of Patent: Oct. 9, 2001

(54) POWDER DEVICE WITH A CONSTANT SUPPLY OF POWDER

(75) Inventor: Reiner Haas, Metzingen (DE)

(73) Assignee: Weitmann & Konrad GmbH & Co. (DE)

( * ) Notice: Subject to any disclaimer, the term of this patent is extended or adjusted under 35 U.S.C. 154(b) by 0 days.

(21) Appl. No.: 09/762,628

(22) PCT Filed: Jul. 7, 1999

(86) PCT No.: PCT/EP99/04751

§ 371 Date: Feb. 9, 2001

§ 102(e) Date: Feb. 9, 2001

(87) PCT Pub. No.: WO00/09335

PCT Pub. Date: Feb. 24, 2000

(30) Foreign Application Priority Data

Aug. 10, 1998 (DE) ..... 198 36 021

(51) Int. Cl.[7] ..... B67D 5/08
(52) U.S. Cl. ..... 222/64; 239/654; 239/71
(58) Field of Search ..... 222/64; 239/654, 239/655, 71, 74

(56) References Cited

U.S. PATENT DOCUMENTS

| | | | | |
|---|---|---|---|---|
| 3,091,368 | * | 5/1963 | Harley et al. | 239/654 |
| 3,604,981 | | 9/1971 | Saito | 317/3 |
| 5,090,626 | * | 2/1992 | Platsch | 239/654 |
| 5,178,333 | * | 1/1993 | Barber et al. | 239/654 |

FOREIGN PATENT DOCUMENTS

| | | |
|---|---|---|
| 1 611 317 | 7/1967 | (DE) . |
| 66 05 019 | 1/1971 | (DE) . |
| 38 11 309 | 10/1989 | (DE) . |
| 38 19 203 | 12/1989 | (DE) . |
| 0 528 613 | 2/1993 | (EP) . |
| 0 540 402 | 3/1995 | (EP) . |
| 2 76738 | 3/1990 | (JP) . |
| WO99/10177 | 3/1999 | (WO) . |

* cited by examiner

*Primary Examiner*—Philippe Derakshani
*Assistant Examiner*—Trach H Bui
(74) *Attorney, Agent, or Firm*—Young & Basile, PC

(57) ABSTRACT

A device for powder, wherein a powder container, an intermediate container and a dosing element are successively arranged in a versicle container. The powder is conveyed from the powder container into the intermediate container and, subsequently, into the dosing element. This results in a regular discharge.

9 Claims, 1 Drawing Sheet

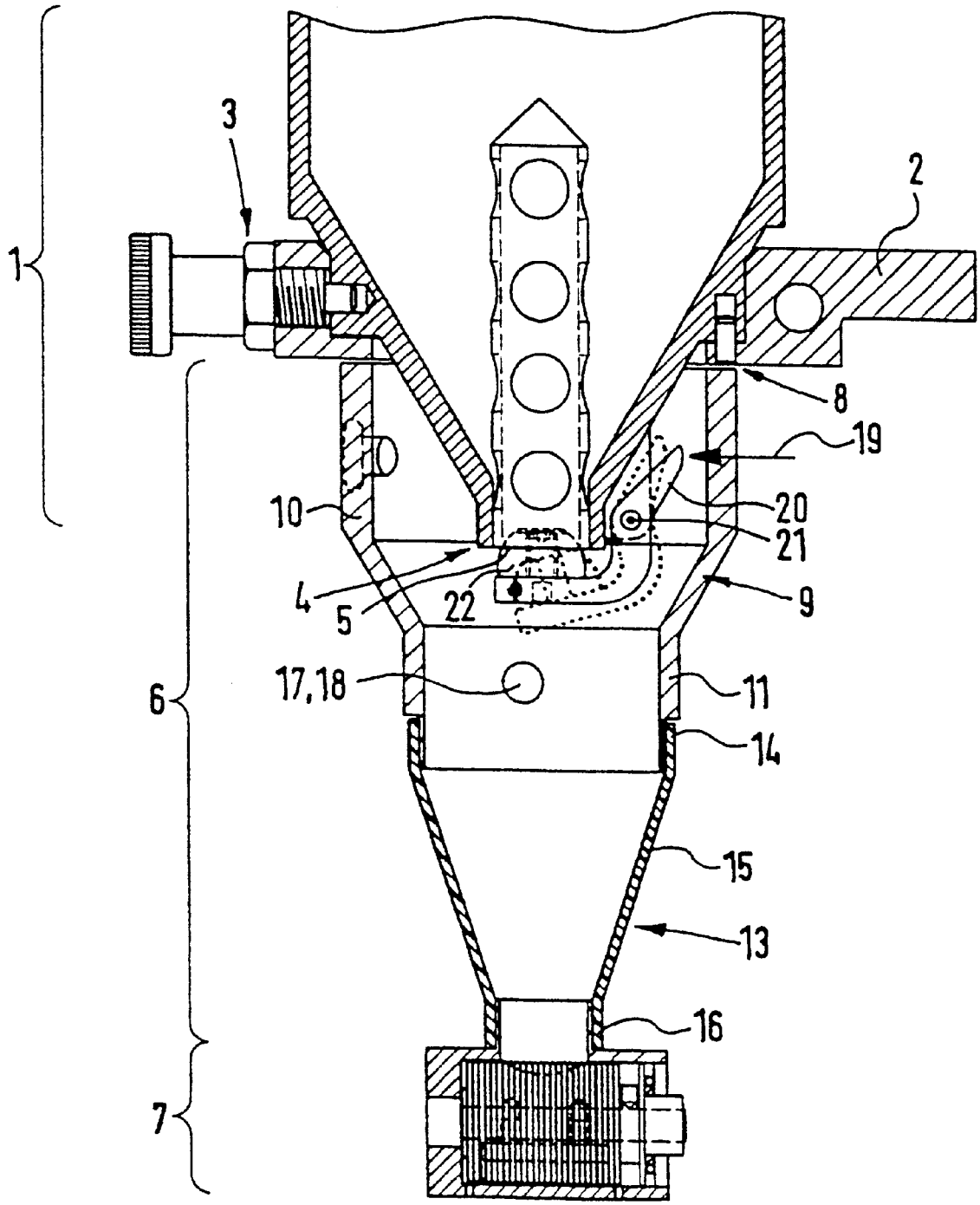
1
2
3
4
5
6
7
8
9
10
11
13
14
15
16
17,18
19
20
21
22

POWDER DEVICE WITH A CONSTANT SUPPLY OF POWDER

DESCRIPTION

The invention concerns a powder device for powder coating printed sheets, with a powder container in which powder is stored and from which powder is taken, where the powder container in particular is designed as a replaceable container and can be removed from the powder device, and with a metering mechanism by means of which a specified quantity of powder is dispensed into a current of air.

It is generally known that printed sheets of paper are powder coated after they leave the printing press so that the printing ink is not smeared as the sheets are being stacked. To do this, a sheet delivery device has a powder device with which the powder is applied to the sheets.

Normally the powder devices have a powder container in which the powder is stored. This powder container has an opening at its lower end, which is sealed, for example, by a ball (DE 38 11 309 A1). In order to be able to take powder from the container, the ball is driven into the container and thus into the powder stored in it, whereby the powder is loosened up. In addition, compressed air is blown in when the container is opened. The powder taken from the container falls into a mixture preparation area in which the compressed air is enriched with powder, and a powder-air mixture is created.

Another device provides for the discharge opening of the powder container to be sealed by a moveable disk. When the disk is moved, a specific quantity of powder trickles out of a gap between the disk and the discharge opening of the powder container. This powder is picked up and carried along by a current of air rushing by. If the powder container on this device is removed, for refilling, for example, the air cannot be enriched with powder. Continuous operation is not possible.

The object underlying the invention is to provide a powder device with which continuous operation is ensured even when the powder container is being replaced.

The object is achieved under the invention by having the powder container empty into an intermediate container and positioning the intermediate container between the powder container and the metering mechanism.

It is essential to the invention that the powder taken from the powder container is not carried directly into the air stream but ends up in an intermediate container, from which the powder is fed through the metering mechanism into the air stream proper. The intermediate container acts as an additional supply chamber, so that powder can continue to be taken from the intermediate container when, for example, the powder container is being replaced, whereby continuous operation is ensured even when the powder container is (briefly) removed.

A further advantage can be seen in that the powder in the intermediate container has a constant density as far as possible, independent of whether the powder was filled into the powder container only a short time previously and therefore still contains a relatively high percentage of air, or whether the powder was filled into the powder container a considerable time previously and has a higher density.

Since the powder from the powder container runs into the intermediate container, and the time spent in the intermediate container is relatively constant, the powder is transferred into the metering mechanism with almost consistent density and consequently with an almost constant percentage of air.

In this way, the amount of powder in the compressed air is adjusted even more precisely to the desired value.

A further embodiment provides that the powder container, the intermediate container and the metering mechanism are positioned vertically one above the other, and the powder is transferred downward from one element to the next. In this way, the powder flows from the powder container by way of the intermediate container to the metering mechanism solely by means of gravity, and no transport air is required. This has the considerable advantage that the powder is not stirred up and that the individual elements do not have to be sealed, or only with conventional means, to atmosphere.

On one working example it is envisaged that the intermediate container is essentially designed to be funnel shaped. This has the considerable advantage that the powder can settle inside the intermediate container, that the air contained in the powder can escape, whereby the powder attains a homogenous density. The air is expelled from the powder by means of the gradual narrowing of the cross section of the intermediate container.

An additional advantage of the invention can be seen in the intermediate container having, at least partially, an elastic outer wall. By means of the elastic outer wall, which is made, for example, of plastic or rubber and is in turn also funnel-shaped, formation of bridges or pillars inside the powder stored in the intermediate container is prevented.

Normally the powder container has a means of causing the powder container to vibrate, for example, a vibrator or a drive to open and close the discharge opening, and normally the metering mechanism also causes vibrations, which are transferred to the intermediate container. These vibrations create movement in the elastic container wall, so that, as a result of these vibrations, the powder is preventing from baking onto the interior container wall. The elastic outer wall is positioned directly ahead of the metering mechanism. This is where the cross section in the intermediate container is at its narrowest, and where the risk of bridging is greatest.

Consistent filling of the intermediate container is achieved under the invention by the intermediate container having a sensor to register the fill level of the powder. If the level drops below a preset value, powder is taken from the powder container and the intermediate container is replenished. The hysteresis between the sensor signal and the replenishment can be set at any point. The advantage is that the intermediate container is always replenished when about 10% of the volume of powder stored in it has been removed.

Under a preferred embodiment, the sensor is an optical sensor, an inductive sensor or a capacitative sensor. In the case of an optical sensor, it can be designed as a light curtain, with visible or infra-red light.

An additional advantage is also seen in designing the intermediate container as an open system. Using an open system, removal of the powder container is relatively unproblematic, since no provisions have to made for seals or air closures. In addition, open systems of this kind can be produced more economically than systems which are pressurized by compressed air.

In order to allow the powder to drop to the bottom or settle in the intermediate container, the intermediate container is under atmospheric pressure.

Additional advantages, properties and details of the invention can be seen in the dependent claims and in the following description, in which a particularly preferred working example is described in detail, with reference to the drawing. The properties shown in the drawing and named in the claims and in the description can be essential to the invention in each case individually or in any combination.

The drawing shows a lower section of powder container 1, which is attached in a container holder 2 by means of a quick-lock system 3. The container holder 2 swings perpendicular to the plane of the drawing. The powder container 1 has a discharge opening 5 at its lower end 4 for the powder stored in the powder container 1. This discharge opening 5 opens into an intermediate container identified in its entirety as 6, which for its part discharges into metering mechanism, identified in its entirety as 7. This metering mechanism 7 is flexibly mounted above its drive. Between the underside of the container holder 2 and the upper side of the intermediate container 6 there is a gap 8, by which the interior of the intermediate container 6 is connected to atmosphere. Atmospheric pressure therefore obtains in the intermediate container 6. The lower end 4 of the powder container 1 extends relatively far into the intermediate container 6, which ensures that no or only a negligibly small amount of powder escapes through the gap 8. The gap 8 also has the advantage that the intermediate container 6 is not attached to the container holder 2 and therefore also separated from the vibratory motion of the powder container 1.

The section 9 of the intermediate container 6 which faces the powder container 1 has a cylindrical casing 10 at the top and a lower cylindrical casing section 11, which has a smaller diameter than the section 10. The two casing sections 10 and 11 are joined by means of a tapered casing section 12. An upper cylindrical casing section 14 of a lower section 13 is pushed onto the open end of the lower casing section 11. A tapered casing section 15, which terminates in a cylindrical lower casing section 16, is attached to this casing section 14 in the same way. This lower casing section 16 is attached to the metering mechanism 7.

Section 13 of the intermediate container 6 consists of an elastic material, for example, plastic or rubber, whereas section 9 is made of a rigid material, for example, aluminum. Because the metering mechanism 7 is switching on and off, particularly the drive for the metering mechanism 7, vibrations are introduced into section 13. These vibrations or motions respectively cause a deformation in the elastic wall of section 13, whereby the powder located in the intermediate container 6 is loosened, or at least is prevented from baking on or forming pillars and bridges. This ensures a flow or stream of powder in the direction of the lower outlet.

From the drawing it can also be seen that a sensor 17, in particular a light curtain 18, is provided in material section 11, by which the fill level in the intermediate container 6 is determined. If the level falls below a specified threshold value, a drive (not shown) is activated by means of the sensor 17, which acts in the direction of the arrow 19 on a rocker, which is mounted to pivot around an axis 21. This causes a closing mechanism 22 to be lifted from the discharge opening 5, and powder can flow out of the powder container I into the intermediate container 6. The powder, which is charged with air, is settled inside the tapered casing section 15 and a uniform density is achieved. In this way the discharge is evened out through the metering mechanism 7.

Additionally, the fill level is permanently maintained at the same height during operation, so that the fill level in the intermediate container has no effect on the metering. The height of the level in the powder container and the density of the powder in the powder container have no effect on the metering, because the powder container is completely separated from the metering process. This is because the intermediate container is positioned between the powder container and the metering mechanism.

What is claimed is:

1. A powder device to powder coat printed sheets, with a powder container, in which powder is stored and from which powder is taken, and with a metering mechanism, by means of which a specific quantity of powder is dispensed into a current of air, where the powder container discharges into an intermediate container and the intermediate container is located between the powder container and the metering mechanism, characterized in that a discharge opening of the powder container lies above a fill level in the intermediate container and the powder container, the intermediate container and the metering mechanism are positioned vertically and sequentially one above the other, and the powder is transferred from one to another downwardly.

2. The powder device in accordance with claim 1, characterized in that the intermediate container is funnel shaped.

3. The powder device in accordance with claim 1, characterized in that the intermediate container has at least a partially elastic wall.

4. The powder device in accordance with claim 2, characterized in that the elastic wall is located immediately ahead of the metering mechanism.

5. The powder device in accordance with claim 1, characterized in that the intermediate container has a sensor which indicates the fill level.

6. The powder device in accordance with claim 5, characterized in that the sensor is one of an optical sensor.

7. The powder device in accordance with claim 1, characterized in that the intermediate container is designed as an open system.

8. The powder device in accordance with claim 1, characterized in that atmospheric pressure is present in the intermediate container.

9. The powder device in accordance with claim 1, characterized in that the powder container is designed as a replaceable container and can be removed from the powder device.

* * * * *